United States Patent [19]

Ellis et al.

[11] Patent Number: 4,780,643

[45] Date of Patent: Oct. 25, 1988

[54] SEMICONDUCTOR ELECTRODES HAVING MULTICOLOR LUMINESCENCE

[75] Inventors: Arthur B. Ellis; Michael K. Carpenter, both of Madison, Wis.

[73] Assignee: Minnesota Mining and Manufacturing Company, St. Paul, Minn.

[21] Appl. No.: 480,471

[22] Filed: Mar. 30, 1983

[51] Int. Cl.[4] ..... H05B 31/14

[52] U.S. Cl. ..... 313/503; 313/507

[58] Field of Search ..... 313/498, 499, 501, 503, 313/504, 506, 507, 500

[56] References Cited

U.S. PATENT DOCUMENTS

| | | | |
|---|---|---|---|
| 2,921,218 | 1/1960 | Larach et al. | 313/503 |
| 3,225,253 | 12/1965 | Narken et al. | 313/507 X |
| 3,648,052 | 3/1972 | Nakamura et al. | 313/507 X |
| 3,783,353 | 1/1974 | Pankove | 313/499 X |
| 3,875,473 | 4/1975 | Lebailly | 313/499 X |
| 4,211,586 | 7/1980 | Fang et al. | 313/500 X |
| 4,356,429 | 10/1982 | Tang | 313/504 X |
| 4,364,995 | 12/1982 | Crawford et al. | 428/336 |
| 4,543,511 | 9/1985 | Ellis et al. | 313/507 X |

OTHER PUBLICATIONS

*Integrated Multicolor Light-Emitting Diode Array,* IBM Technical Disclosure Bulletin, Blum et al, vol. 15, No. 2, Jul. 1972, pp. 445, 446.

*Primary Examiner*—David K. Moore
*Assistant Examiner*—K. Wieder
*Attorney, Agent, or Firm*—Donald M. Sell; Mark A. Litman

[57] ABSTRACT

A multicolor luminescent article comprises a layer of a first luminescent semiconductor having a discontinuous layer, pattern or image comprised of a second luminescent semiconductor on at least one surface thereof.

1 Claim, No Drawings

SEMICONDUCTOR ELECTRODES HAVING MULTICOLOR LUMINESCENCE

TECHNICAL FIELD

This invention relates to semiconductor materials which exhibit photoluminescence.

BACKGROUND OF THE ART

Electroluminescence occurs in semiconductor materials which are capable of emitting visible or near visible radiation when an electrical current passes through the semiconductor. Photoluminescence can also occur in these materials. If external light is used to excite the semiconductor while there is an applied voltage across the material, a characteristic wavelength of light is emitted. These characteristic wavelengths vary amongst different photoluminescent semiconductors and can be varied in a single semiconductor by doping the material. The dopant will ordinarily cause a shift in the wavelength of radiation emitted by the material.

Amongst the various studies on the luminescence of photo-stimulated electroluminescent materials is "Luminescent Photoelectrochemical Cells", Streckert, H. H., Tong, J. and Ellis, A. B., J. Am. Chem. Soc., Vol. 104, No. 2, 1982, pp. 581–588. It is noted therein that the intensity of light emitted by electroluminescence varies directly with the applied voltage. The efficiency of charge transfer and good electrical contact at the surface is also noted as important in the efficiency of the process.

SUMMARY OF THE INVENTION

It has been found in the practice of the present invention that a multicolor electroluminescent article may be produced. The article must comprise a layer of a first electroluminescent semiconductor, and over only a portion of the surface of said layer a second electroluminescent semiconductor emitting a characteristic wavelength at least 50 nm different from the characteristic wavelength of the first semiconductor.

DETAILED DESCRIPTION OF THE INVENTION

Many different types of materials, both inorganic and organic in nature are known to electroluminesce. Amongst these materials are lanthanum oxysulfide, gadolinium oxybromides, gadolinium oxysulfide, lanthanum oxybromide, cadmium sulfide, cadmium selenide, zinc oxide, zinc sulfide, zinc selenide, cadmium telluride, poly-N-vinylcarbazole, substituted poly-N-vinylcarbazoles, bisbenzocarbazolephenylmethane and others. These materials are generally used as homogeneous layers or homogeneously dispersed layers. For example, commercial X-ray intensifying screens homogeneously mix materials to alter the effective wavelength of radiation emitted.

The present invention provides a non-homogeneous surface having a pattern-wise distribution of different electroluminescent semiconductors on that surface so that an image pattern is provided when the surface is caused to luminesce. The at least two electroluminescent semiconductors must have characteristic emissions which differ by at least 50 nm to be distinguishable by the human eye. Preferably the emissions will differ by at least 100 nm and more preferably by at least 200 nm to effect good visual contrast.

The article providing this construction may be produced by any of a number of means. A first layer may be formed by conventional means such as coating of the semiconductor in a binder, thermal vapor deposition, sputtering, crystallization out of solution and the like. The second, pattern-distributed electroluminescent semiconductor may be deposited on the surface by any of these methods, the pattern being formed by a number of alternative procedures. The surface of the first semiconductor may be masked during the deposition of the second photoconductor. A continuous layer of the second semiconductor may be etched in a pattern using a resist layer. A prepatterned, disconinuous electroluminescent layer also may be adhered to the surface of the first semiconductor. Each of these procedures is capable of providing a construction according to the present invention.

The article may also be constructed by etching an electroluminescent layer which does not contain distinct layers of different semiconductors, but rather has a graded zone of change between at least two different electroluminescent materials. By having a gradation of such materials, the amount of etching performed at any spot in the surface will control the wavelength of the emission from that spot. For example, first consider a cadmium selenide substrate having sulfur diffused in through its surface to a depth of about one micrometer. The surface will emit in the green from the cadmium sulfide, but if the surface is progressively etched to regions of increasing cadmium selenide concentrations, the light emitted would pick up progressively more red until pure cadmium selenide was reached and then only the characteristic red would be emitted. These graded articles may be provided by any procedure that is capable of providing the graded structure required. Various thermal vapor deposition and sputtering processes would be the best way of producing the structures. In particular, the process and apparatus described in U.S. Pat. No. 4,364,995 would be particularly useful, with only minor changes needed in the materials provided in the coating procedure. For example, that apparatus uses a baffle to partially separate two vapor deposition streams. If one luminescent photoconductor is provided on one side of the baffle and a second photoconductor on the other, a graded intermediate zone can be provided. The thickness of the total layer or individual ingredients is controlled by the amount of photoconductor evaporated. The degree and rate of mixing in the graded zone is controlled by the extension of the baffle. Mixtures of three or more photoconductors can be made by adding a second baffle to the chamber. Extremely thin layers can be provided by these procedures and even tricolor emissions could be made in a 1–2 $\mu$m layer.

The thickness of the various layers is not critical. The layers only need to be thick enough to provide a sufficient intensity of emitted light upon excitation. If the emitted light is to be visible, a thickness of at least 0.01 micrometers for each layer is necessary. Preferably dimensions of at least 0.05, 0.10 or even 0.50 micrometers are desirable. Greater thicknesses do not provide significantly better results. Thicknesses of 1 to 10 microns work equally as well, but are more costly. With greater thicknesses of the top layer, particularly where etching is performed, increased production costs would also be encountered.

The voltage may be applied to the article of the present invention by any configuration which does not block the emission of light from the surface. The article may be placed in an electrolyte solution with anodic and cathodic connections to the two surfaces of the article. A more convenient construction uses transparent conductive layers on both surfaces. Such layers could comprise transparent conductive polymers, transparent conductive filled polymers, transparent metal films and the like. The transparency is, of course, necessary only on the emitting surface, and any conductive layer may be used on the back side of the article.

The graded construction can also provide particular advantages based on properties disclosed in a companion application, Ser. No. 478,476 now U.S. Pat. No. 4,543,511, filed on Mar. 25, 1983 in the names of Arthur B. Ellis and Holger H. Streckert entitled "Semiconductor Electrodes Having Regions Of Graded Composition Exhibiting Photoluminescence and Electroluminescence". According to that disclosure, graded substrates may exhibit variable color emission depending upon the applied voltage. Such an article would have a luminescent layer comprising a first photoluminescent semiconductor having at least one material present in solid solution with said first semiconductor which alters the spectral luminescence of said first semiconductor, said material being selected from the group consisting of a dopant for said first semiconductor having a spectral emission differing by at least 50 nanometers from the spectral emission of said first semiconductor, the concentration of said second component being greater at one surface of said layer than at the other surface, the concentration of said material varying with respect to the first semiconductor by at least 40% by weight through a thickness of 0.01 to 1 $\mu$m from said one surface.

The semiconductor substrates which exhibit variable color emission in accordance with the present invention are preferably characterized as solid state solutions of three elements, including at least one metal and at least one non-metal element: these elements function in the electrode substrate as a constant element, a substituent element and a displaced element. The concentration of the substituent and the displaced elements, both of which are either metals or non-metals, is varied, preferably monotonically, with depth such that the band gap energy between the valence and conduction bands changes with depth. For emissions in the visible spectrum, assuming band edge emission, the band gap would preferably vary between about 1.7 eV and 3 eV.

Any combination of three metal and non-metal elements that form solid solutions together which satisfied the foregoing band gap energy requirements may be utilized in accordance with the present invention. Examples of such trios of elements are: cadmium, selenium and sulfur; zinc, selenium and sulfur; cadmium, zinc and sulfur; and cadmium, selenium and zinc. To the extent that such elements satisfy the foregoing requirements of forming solid solutions at all levels of substitution and having appropriate band gap energies, any one of the trio of elements may serve as the constant element, the displaced element or the substituent.

These and other aspects of the present invention can be seen in the following non-limiting examples.

EXAMPLE 1

As a specific illustrative example of a graded device formed in accordance with the invention, graded cadmium sulfide/cadmium selenide ($CdS_xSe_{1-x}$, $0 \leqq X \leqq 1$) samples were prepared from 5 by 5 by 1 millimeter, vapor-grown, single-crystal c-plates of n-type cadmium selenide (resistivity approximately 2 ohm-cm; 4-point probe method). A CdSe plate was etched with $Br_2$ in methanol (1:10 V/V) and placed in a 6-millimeter inside diameter, 8-millimeter outside diameter quartz tube with approximately 0.6 milligrams of sulfur, which was free of metallic impurities to better than 10 parts per million (ppm). The quartz ampoule was evacuated (approximately 1 torr), sealed to a volume of about 2 cubic centimeters and placed in a preheated Lindberg furnace (700° C.) for 15 minutes. After the ampoule was removed from the furnace, one end was contacted by a heat sink to prevent the sulfur from condensing on the crystal substrate. The crystal substrate was then removed and placed in a similar tube with approximately 1 milligram of cadmium having less than 1 ppm of metallic impurities. The tube was evacuated and sealed and again heated at 700° C. for 15 minutes. After its removal from the ampoule, a gallium-indium ohmic contact was formed on one surface of the substrate and a copper wire attached to the contact with silver epoxy. The substrate was then encapsulated in epoxy, leaving one surface exposed, and mounted in an electrochemical cell containing an electrolyte, a platinum counterelectrode, and an SCE reference electrode.

A polymeric resist layer in a recognizable pattern was painted on the surface of the layer having the diffused sulfur therein, and the exposed surface etched to a depth sufficient to expose the pure cadmium selenide. The resist was then dissolved from the surface.

The emission electrode with an etched, graded, substituted surface layer prepared as described above was incorporated in a cell with a platinum counterelectrode and a SCE reference electrode and connected to a source of variable voltage potential. Aqueous alkaline polysulfide electrolyte (1 M $OH^-$/1 M $S^{2-}$/0.1 M S) or aqueous alkaline peroxydisulfate, or aqueous alkaline sulfide (1 M $OH^-$/1 M $S^{2-}$) electrolyte could be used in the cell. The emission electrode had an exposed surface area of approximately 0.15 square centimeter. To facilitate analysis of the emission spectra, the cell was constructed in the sample compartment of an emission spectrometer. Front surface electroluminescence spectra were obtained. The electrolyte used was 0.1M peroxydisulfate and was purged by bubbling $N_2$ through it. A visible image could be visually observed in a reduced lighting background.

An image of green on a red background was produced.

We claim:

1. A luminescent article comprising a semiconductor layer selected from the group consisting of an electroluminescent and photoluminescent semiconductor layer, the composition of which layer consists essentially of a mixture of cadmium sulfide and cadmium selenide, there being a graded change in the composition of said layer such that the concentration of cadium sulfide increases when moving from one surface of said layer to the other surface of said layer, said layer exposing different depths of the composition of said layer to provide different visible color emissions upon stimulation.

* * * * *